United States Patent [19]

Burg et al.

[11] Patent Number: 4,970,962

[45] Date of Patent: Nov. 20, 1990

[54] DOUBLE TURNOUT ROTARY GUIDEWAY SWITCH

[75] Inventors: Thomas J. Burg, Forest Hills; Ronald H. Ziegler, Elizabeth; William K. Cooper, Monroeville; John W. Kapala; Robert J. Anderson, both of McMurray, all of Pa.

[73] Assignee: AEG Westinghouse Transportation Systems, Inc., Pittsburgh, Pa.

[21] Appl. No.: 211,736

[22] Filed: Jun. 27, 1988

[51] Int. Cl.[5] ..... E01B 25/06

[52] U.S. Cl. ..... 104/130; 191/29 R; 246/258; 246/415 R; 246/419; 246/431; 246/448

[58] Field of Search ..... 246/257, 258, 415 R, 246/419, 431, 448; 104/101, 130, 247; 191/29 R

[56] References Cited

U.S. PATENT DOCUMENTS

| | | | |
|---|---|---|---|
| 557,338 | 3/1896 | Osborne | 246/431 |
| 557,339 | 3/1896 | Osborne | 246/431 |
| 569,034 | 10/1896 | Sturgis et al. | 46/431 |
| 1,516,513 | 11/1924 | Taffe | 246/431 |
| 1,833,679 | 11/1931 | Jefferson et al. | 246/257 |
| 3,113,529 | 12/1963 | Maestrelli | 246/431 X |
| 3,308,766 | 3/1967 | Urbinati | 246/431 X |
| 3,640,227 | 2/1972 | Webb | 104/130 |
| 3,774,544 | 11/1973 | Mouillon | 104/130 |
| 3,782,291 | 1/1974 | Maison | 104/130 X |
| 3,835,785 | 9/1974 | Kirschner et al. | 104/130 |
| 3,972,293 | 8/1976 | Watts | 104/130 |
| 4,090,452 | 5/1978 | Segar | 104/130 X |
| 4,109,584 | 8/1978 | Mihirogi | 104/130 |
| 4,132,175 | 1/1979 | Miller et al. | 104/130 |
| 4,215,837 | 8/1980 | Vozumi et al. | 246/433 |
| 4,428,552 | 1/1984 | Frank et al. | 246/258 X |
| 4,453,051 | 6/1984 | Brown | 191/29 R X |

FOREIGN PATENT DOCUMENTS

| | | | |
|---|---|---|---|
| 1474851 | 3/1967 | France . | |
| 0589233 | 3/1959 | Italy | 104/130 |
| 0010715 | 3/1895 | United Kingdom | 246/448 |

OTHER PUBLICATIONS

"C45 Vehicle System Development Program", APTA Conference, Jun. 5-8, 1988, Westinghouse Transportation Systems and Support Division.

*Primary Examiner*—Andres Kashnikow
*Attorney, Agent, or Firm*—Spencer & Frank

[57] ABSTRACT

A double turnout rotary guideway switch is provided with an elongated structural frame member having guidebeam, electric rail and tire path structure on each of two sides of the switch compatible with the guidebeam, electric rail and tire path structure of the guideway. Two elongated beams form the sides of the frame and, with cross connected end beams, operating as the principal structural members for the frame. A curved beam extends from one of the elongated side beams inwardly and to one of the end beams. Opposite sides of the curved beam provide respective surfaces for a left turnout tire path on one of the two sides of the switch and a right turnout tire path the other side of the switch.

13 Claims, 17 Drawing Sheets

WELDED FASCIA BEAM
DOUBLE TURNOUT
GUIDE BEAMS
FASCIA BEAM
2'-5
2'-5
750
758
760
762
763
764R
770
771R
771L
756
756B
756C
759
736P
736F
766B
766T
778L

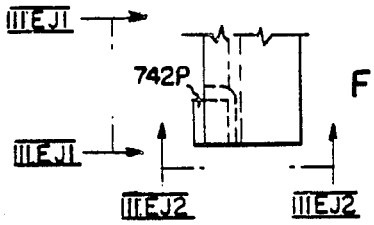
FIG. 3EJ.
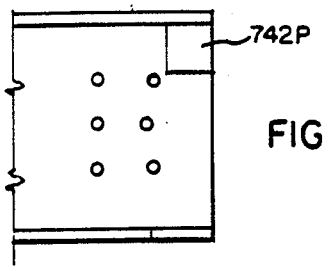
FIG. 3EJ1.
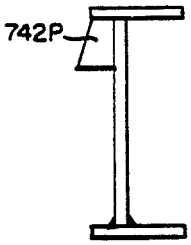
FIG. 3EJ2.
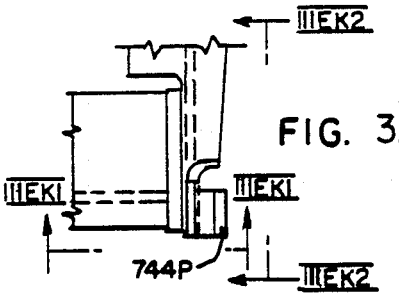
FIG. 3EK.
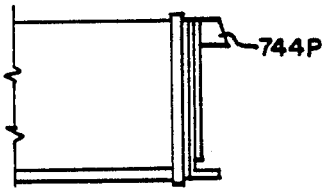
FIG. 3EK1.
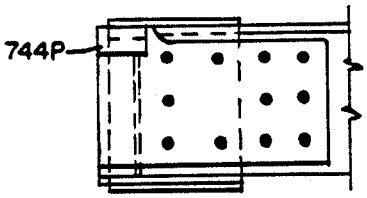
FIG. 3EK2.

TYPE "X"

DOUBLE TURNOUT ROTARY GUIDEWAY SWITCH

CROSS REFERENCE TO RELATED APPLICATIONS

The following related and concurrently filed and coassigned patent applications are hereby incorporated by reference:

U.S. patent application Ser. No. 07/211,734, filed concurrently, entitled ROTARY GUIDEWAY SWITCH FOR PEOPLE MOVER SYSTEMS and filed by Thomas J. Burg, William K. Cooper, Robert J. Anderson, Ronald H. Ziegler and John W. Kapala.

U.S. patent application Ser. No. 7/213,206, filed concurrently, entitled ELECTRIC COUPLING FOR ROTARY GUIDEWAY SWITCH and filed by Thomas J. Burg.

U.S. Patent application Ser. No. 7/211,734, filed concurrently, entitled SAFETY LOCKING STRUCTURE FOR A ROTARY GUIDEWAY SWITCH and filed by Thomas J. Burg, William K. Cooper and Robert J. Anderson.

U.S. patent application Ser. No. 7/211,725, filed concurrently, entitled GUIDEWAY STATION FOR A ROTARY GUIDEWAY SWITCH and filed Thomas J. Burg, Robert J. Anderson and Ronald H. Ziegler.

U.S. patent application Ser. No. 07/211,726, filed concurrently, entitled ROTARY GUIDEWAY SWITCH HAVING SINGLE TIRE PATH LOADING and filed by Thomas J. Burg, William K. Cooper, Robert J. Anderson, Ronald H. Ziegler and John W. Kapala.

U.S. patent application Ser. No. 07/211,735, filed concurrently, entitled SELF-ALIGNING ROTARY GUIDEWAY SWITCH and filed by Thomas J. Burg.

U.S. patent application Ser. No. 07/211,610, filed concurrently, entitled SINGLE TURNOUT ROTARY GUIDEWAY SWITCH AND A DUAL LANE CROSSOVER STATION EMPLOYING THE SAME and filed by Thomas J. Burg, William K. Cooper, Robert J. Anderson, Ronald H. Ziegler and John W. Kapala.

U.S. patent application Ser. No. 07/211,721, filed concurrently, entitled IMPROVED ELECTRIC GUIDANCE, AND TIRE PATH CONFIGURATION FOR A PEOPLE MOVER GUIDEWAY and filed by William K. Cooper, Thomas J. Burg, and John W. Kapala.

U.S. patent application Ser. No. 07/211,724, filed concurrently, entitled ROTARY GUIDEWAY SWITCH HAVING GUIDEBEAM AND/OR ELECTRIC RAIL STRUCTURE LOCATED ABOVE AND BETWEEN GUIDEWAY TIRE PATHS, filed by Thomas J. Burg, William K. Cooper, Robert J. Anderson, Ronald H. Ziegler and John W. Kapala.

BACKGROUND OF THE INVENTION

The present invention relates to people mover systems and more particularly to guideway switches for such systems.

In cross referenced basic patent application Ser. No. 07/211,723, W.E. 53,893, a general background description is presented and there is disclosed the structure and operation of a new rotary guideway switch and a new guideway configuration for people mover systems. That disclosure embodies a plurality of basic and improvement inventions and accordingly a family of patent applications, including the present application and those applications listed in the Cross-Reference section, are being filed concurrently in correspondence to the respective inventions.

The present patent application is directed to a rotary guideway switch that is structured to provide car switching from a main line to either of the two turnout paths.

SUMMARY OF THE INVENTION

A double turnout rotary switch is provided for a people mover guideway system having a predetermined tire path, guidebeam and electric rail configuration. The rotary switch routes a transit car from a main line entry guideway path to a left turnout exit guideway path or a right turnout guideway exit path.

The switch comprises an elongated structural switch frame member having guidebeam, electric rail and tire path structure on one side compatibly with the guideway configuration to provide car routing to the left turnout exit path. The switch frame further has guidebeam, electric rail and tire path structure on another side compatibly with the guideway configuration to provide car routing to the right turnout exit path. The frame is supported for operation by a pair of shafts and locking means at the opposite frame ends.

At least one of the shafts is driven to rotate the switch frame between first and second rotational positions. The switch frame has its one side aligned with the entry guideway path and the one exit guideway path in the first frame position and it has its other side aligned with the entry guideway path and the other exit guideway path in the second frame position. In the preferred embodiment, the frame includes a pair of spaced, elongated and generally curved beam means that operate as principal structural members for the frame and further provide respective tire running surfaces for the left and right turnout paths on the two sides of the switch.

DESCRIPTION OF THE DRAWINGS

The invention is described below with reference to the accompanying drawings, a brief description of which follows. The Figure numbers of sectional views are keyed to reference planes denoted by Roman numerals and letters. For example, the sectional view of FIG. 2A is taken through reference plane II A in FIG. 2.

FIGS. 3BA through 3BF show various double turnout switch pit views taken along the indicated reference planes in FIG. 3B;

FIGS. 3EJ–3EK2 and 3EN and 3EP–3ES show various views of safety stop structure for the double turnout switch embodiment.

DESCRIPTION OF THE PREFERRED EMBODIMENT GUIDEWAY SYSTEM

Figure 1:
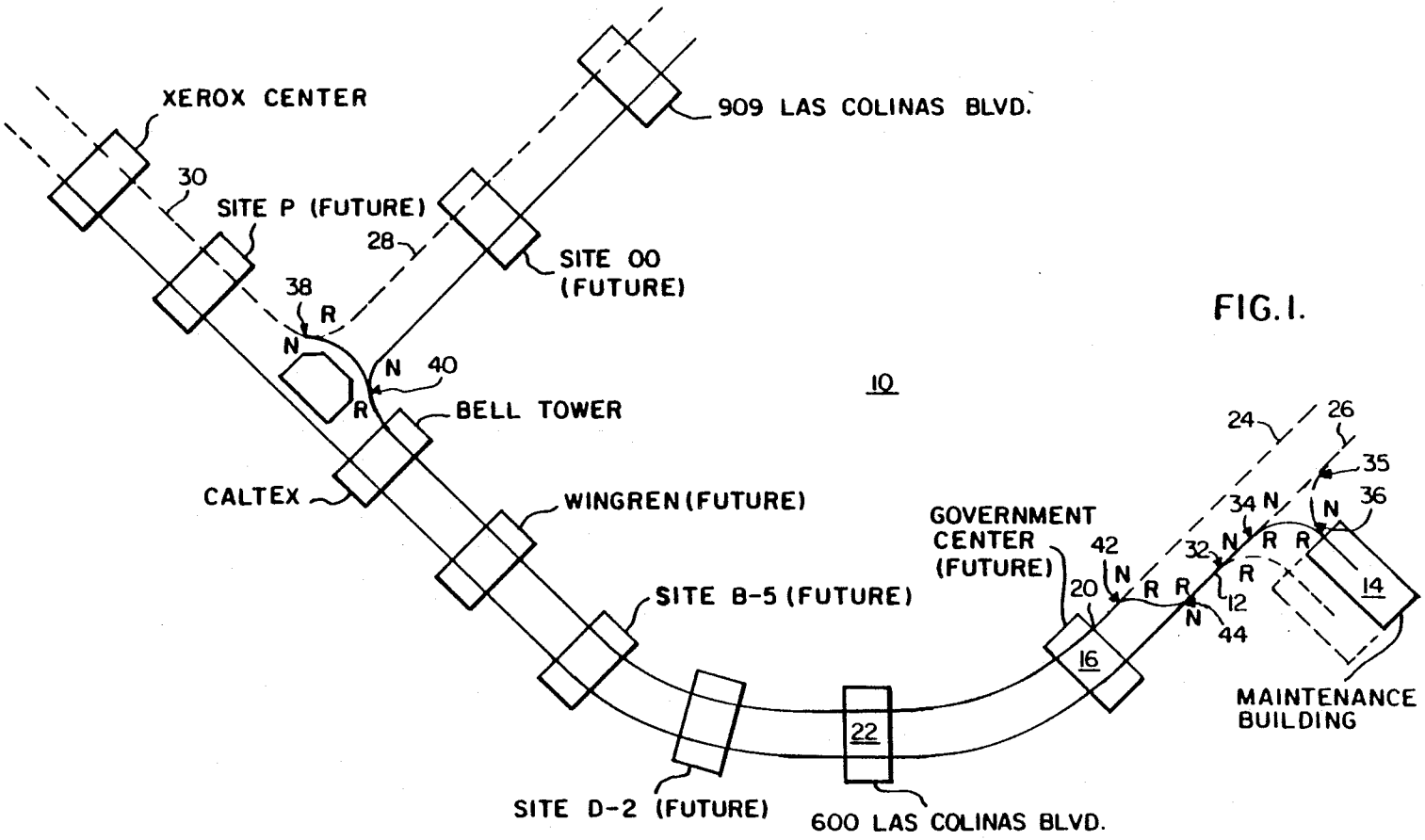
FIG. 1 shows a schematic diagram of a guideway layout for a people mover system having rotary guideway switches made and operated in accordance with the principles of the invention.
Figure 1A:
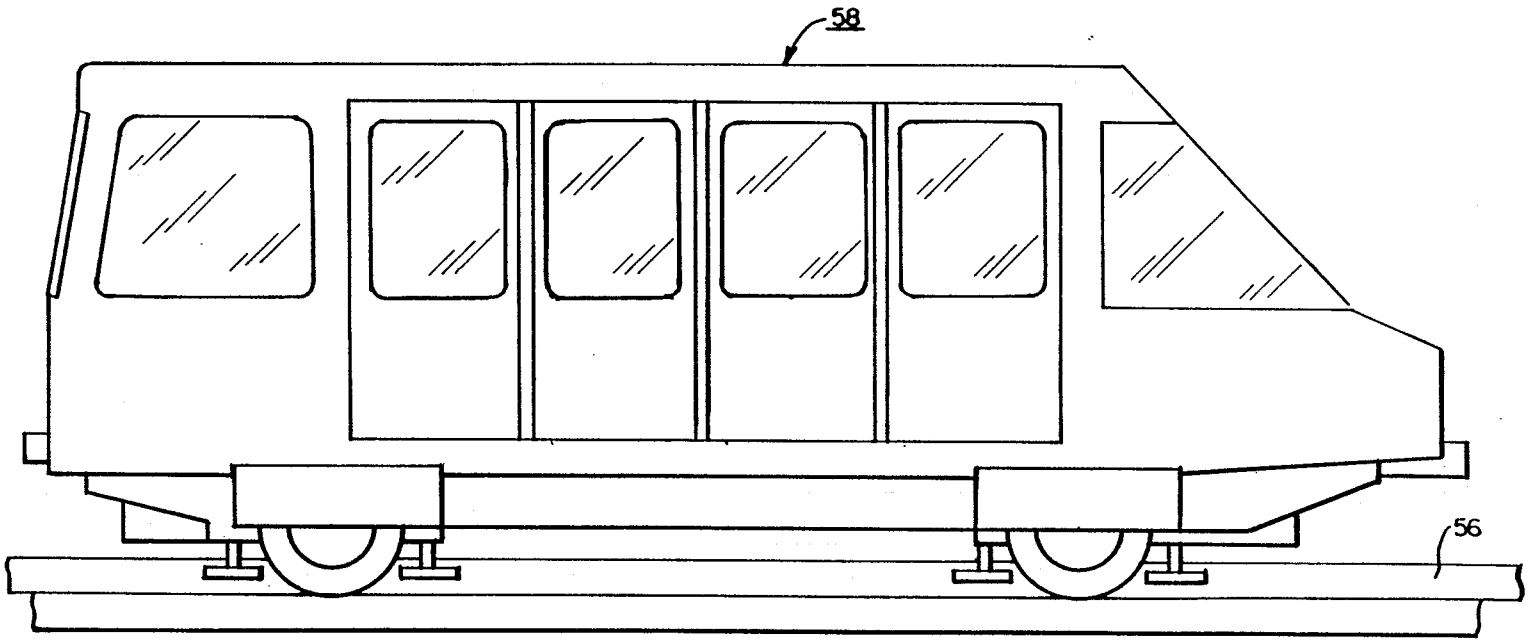
FIG. 1A shows an elevational view of a car of the type employed on the guideway of FIG. 1.

More particularly, there is shown in FIG. 1 a people mover system 10 in which the present guideway switch invention is embodied. The system 10 is a schematic representation of Phase 1 of a people mover system being commercially supplied by the assignee of the present invention to a location in Texas and referred to as the Las Colinas Area Personal Transit System.

The system 10 includes a first guideway lane 12 which extends from a maintenance building 14 to a Government Center Station 16 through various other stations to a Xerox Center Station which is currently the last station on the guideway lane.

A second guideway lane 20 extends from the station 16 to a Las Colinas Boulevard Station 22. Normally, where guideway lanes are placed beside each other along a common run, it is desirable that the lane spacing be minimized consistent with operating requirements because of construction and land costs. Once the lane spacing is defined, it is highly desirable that any guideway switches needed for lane switching be structured so that they can be located within the available lane space without requiring costly widening of the lane spacing around the switch locations. In the present case, the spacing between lane centerlines is 11 feet.

Dotted guideways 24, 26, 28, and 30 represent planned future guideway additions. Various additional stations are provided for the guideways as indicated by the illustrated blocks with accompanying station names.

In the present system configuration, right hand single turnout guideway switches 32 and 34, as well as a planned future left hand single turnout switch 35, are located near the Maintenance Building. A double turnout guideway switch 36 is also located nearest the Maintenance Building and two double turnout guideway switches 38 and 40 are located near the Caltex station.

Guideway switches 42 and 44 provide a crossover between the lanes 12 and 20 of a dual guideway. The crossover guideway switches 42 and 44 are right hand single turnout switches which provide the lane crossover routing without requiring widening of the specified guideway lane spacing. Use of transfer tables, pivotal switches and other prior art schemes would require lane widening for switch placement.

GUIDEWAY CONFIGURATION

Figure 1B:
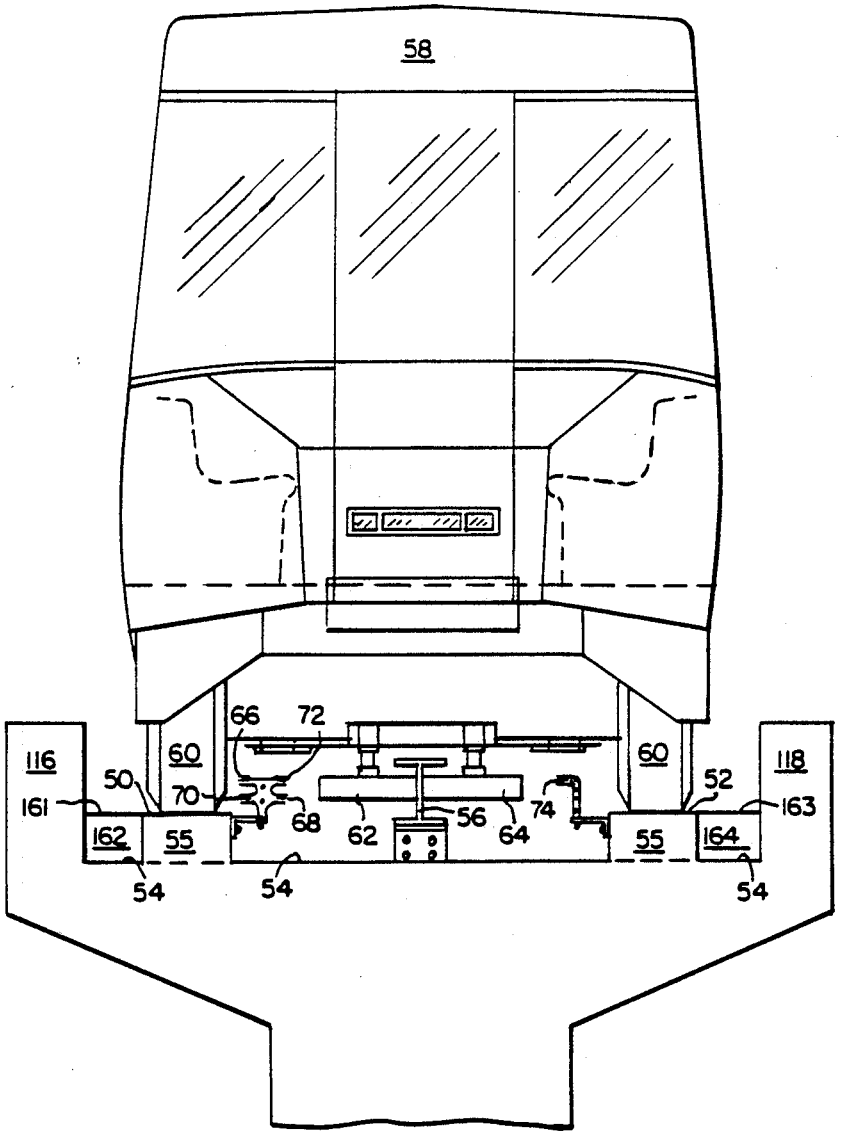
FIG. 1B highlights the guideway configuration at a typical cross section of the guideway with a vehicle on it.

The guideway configuration is illustrated in FIG. 1B by means of a cross-sectional view of the elevated guideway with a vehicle on it. Generally, the guideway can be structured so that the vehicle tire running surfaces are above or below or at ground level. A vehicle 58 is provided with rubber tires 60 that propel the vehicle 58 when running vertically on surfaces 50 and 52.

As shown, the guideway tire running surfaces 50 and 52 can be spaced surface portions running along the length of the surface of an elongated concrete guideway slab 54. In this case, it is preferred that the running surfaces be provided on pads 55 elongated in the longitudinal direction and extending slightly upwardly from the concrete guideway structural slab 54. Cable troughs 162 and 164 are respectively provide outwardly of the tire running pads. Metallic covers 161 and 163 are provided for the troughs 162 and 164. If the vehicle should become disabled and stop at any point along the guideway, the surface of the cover 161 and the tire pad surface 50 together and the surface of the cover 163 and the pad tire surface 152 together form respective sidewalks for passenger use.

A guidebeam 56 is supported by the slab 54 and extends along the slab 54 midway between the running surfaces 50 and 52. The vehicle 58 carries guide wheels 62 and 64 having rubber tires that run horizontally along the guidebeam structure provided by successive guideway slabs to provide lane guidance for the vehicle 58.

Electric rail structure runs along the length of the guideway slab and is supported above and to one side of each of the running surfaces. Generally, the rail structure is configured to provide electric power for vehicle propulsion and electric signals for vehicle control.

Specifically, rails 66, 68 and 70 carry power current for the vehicle 58 and rails 72 and 74 carry central station control signals for directing vehicle operation on the guideway.

In the preferred guideway configuration, the electric rail and guidebeam structure is located above and between the vehicle tire paths and it is organized to enable continuous current collection through continuous electric railing at guideway switch locations without mechanical on/off rail ramping of the car collector assemblies. By this location definition it is meant that the current collection surfaces on the electric rails and the guidance surface on the guidebeam are located above and between the tire surfaces. Normally most or all of the guidebeam and electric rail structure would thus be above the reference plane through the tire paths, but some portions of this structure may be located below the tire path reference plane so long as the current collection and guidance surfaces are located above this reference plane and between the tire paths. Current collection and guidance hardware on the underside of the vehicle can thus be designed to provide: (1) specified ground clearance for the underside of the vehicle; (2) in conjunction with the rail structure, completely reversible vehicle operation on the guideway; and (3) in conjunction with the rail structure, continuous current collection through guideway switch locations without mechanical on/off rail ramping of the vehicle collector assemblies.

Further, the running surface, electric rail and guidebeam structure is preferably symmetrically disposed on the two sides of the guideway lane centerline thereby enabling turnaround operation of vehicles on the guideway. By turnaround operation, it is meant that either end of the vehicle can be the leading vehicle end for vehicle travel over a guideway lane in either guideway direction with guidance and current collection functions being provided in both directions of vehicle travel. Generally, turnaround operation is enabled by the described symmetric disposition of electric rail and guidebeam structure and cooperative placement of guidewheel and collector assemblies on the underside of the vehicle.

Figure 1C:
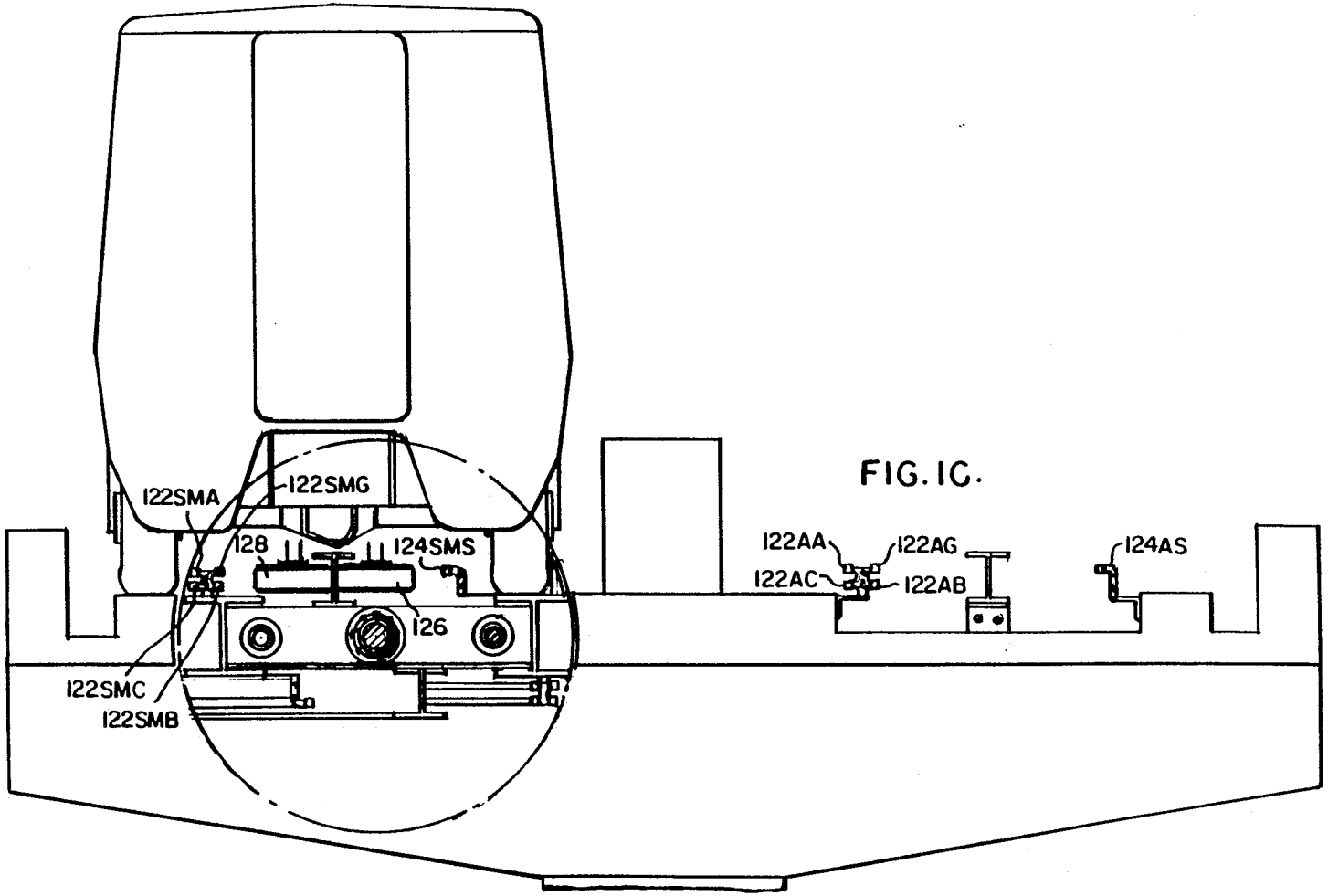
FIG. 1C shows a cross section of a dual lane portion of the guideway at a switch location thereby highlighting the configuration of the rotary guideway switch and its match with the guideway configuration.

FIG. 1C shows a cross-sectional view of the guideway configuration at a guideway switch location. As shown in FIG. 1C, horizontial guide wheels 126 and 128 guide the vehicle over the roadway along the guidebeam 120, in this case the switch guidebeam section 120M. Electrically conductive brushes on the vehicle provide circuit continuity with the electric rail sections 122SMA, 122SMB, 122SMC, 122SMG, and 124SMS as the vehicle moves through the guideway switch 100. The right hand side of FIG. 1C shows a parallel guideway including corresponding electric rail sections 122AA, 122AB, 122AC, 122AG and 124AS.

For more information on the background, functions and advantages of the illustrated guideway configuration, reference is made to the cross-referenced copending patent application Ser. No. 07/211,721.

SINGLE TURNOUT SWITCH-FRAME STRUCTURE AND SWITCH ASSEMBLY

A single turnout rotary guideway switch 100 having a frame 110 is disclosed in the cross-referenced applications and part of that disclosure is included here as an aid to understanding the double turnout rotary guideway switch which is the preferred embodiment in this application.

Figure 2:
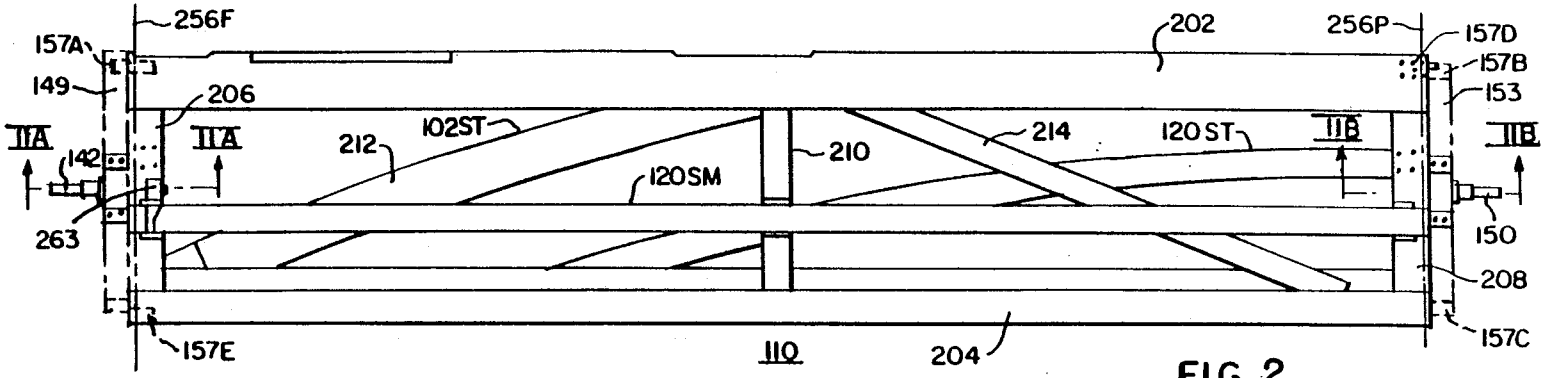
FIG. 2 shows a top plan view of a single turnout rotary frame assembly that includes a portion of the fixed frame supports and a movable part of the guideway switch.

In FIG. 2, the tangent or main lane side of the single turnout rotary guideway switch rotating frame 110 is shown in a plan view. The basic structure of the switch 100 formed by a generally elongated structural frame member 110 comprising parallel longitudinal structural I beams 202 and 204 and frog end, point end and center cross I beams 206, 208 and 210.

From a strength standpoint, the switch framework is arranged to meet all structural and vehicular induced loads within tolerable bending and torsional stresses and specified maximum deflection. From an electrical standpoint, the switch is structured to provide power and signal rail continuity for a vehicle as it enters, passes through and exits the switch.

Generally, the length of the frame 110 is based on the specified radius of curvature for the turnout path at the switching area. A greater radius of curvature requires a greater switch length. In this case, the switch length is approximately thirty-one feet.

The width of the switch frame 110 is preferably less than the overall distance between the tire paths, but the frame width is sufficient to provide the necessary interface width of turnout guideway path on the turnout side of the switch 100 (with the main lane tire path fixed on the side opposite the turnout side). In this way, the rotary switch 100 can be structurally designed with economy for partial car loading as opposed to full car loading. Further, the weight of the rotary switch itself is limited and the rotational diameter of the rotary switch 100 is limited thereby enabling economy in the switch and guideway pit structure and facilitating the operation of the rotary switch 100. In particular, the relatively small size and weight of the switch rotating frame 110 produces efficiency allowing low operational horsepower requirements (less than two horsepower in this application).

The switch frame width in this embodiment is such that the longitudinal beam 202 provides a tire path on the main lane side of the switch 100 for the tires on one side of the vehicle, and the longitudinal beam 204 is placed to lie just inside and below the fixed structure path for the tires on the other side of the vehicle. Thus, only half of the vehicle weight is carried by the rotary switch frame 110 and its support structure in the main lane position.

As in the present case, the rotary switch frame length can be great enough in relation to the vehicle length that a portion of a second vehicle connected to the first vehicle may be located on the rotary switch frame 110 while the entire length of the first vehicle is on the switch frame 110. In that case, the rotary switch frame 110 is designed to support one half of the total vehicle weight that can bear on the main lane side of the rotary switch frame, i.e. the portion of the weight of the full first vehicle translated through the vehicle tires on one side of the vehicle and the portion of the weight of the connected vehicle translated through the single vehicle tire located on the rotary switch frame 110.

On its main lane side, the frame 110 is additionally provided with the main lane guidebeam section 120SM which is secured to the cross beams 206, 208, and 210. The power and signal rail structure is not shown in FIG. 4.

A curved beam 212 provides cross frame support in the diagonal direction between the longitudinal beams 202 and 204 such that it provides the turnout tire running surface 102ST on the turnout side of the rotary switch 100 (the underside of the frame 110 as viewed in FIG. 2). For structural purposes, a bracing I-beam 214 provides similar cross frame support in the opposite diagonal direction. The curved turnout guidebeam section 120ST is also provided on the switch turnout side.

Preferably, fiberglass grating is incorporated into the rotary switch frame to eliminate open areas between structural members and thereby facilitate maintenance and provide a secure stepping surface for passengers who may have to leave a vehicle that has had an emergency stop in the vicinity of a switch. Since the upper and lower sides of the switch frame are used for vehicle routing, the grating is installed to provide for loading on either side of the grating surface. Thus, the grating supports take loading in both directions.

Rotational backup stop action is provided at opposite ends of the switch framework. As indicated by dotted lines in the upper left hand corner of FIG. 2, the safety stop 157A is a stop secured to the frog end fixed equipment frame 149 and is structured and positioned such that its top surface provides stop support, and preferably backup stop support, for the underside of corner portion of top plate of the longitudinal I beam 202 of the frame 110.

Just prior to reaching the main lane stop position, the switch frame 110 is brought to a smooth stop in alignment for insertion of the primary frame supporting lock pins. The described stop structure acts as a backup support in the event lock pins fail to be inserted, i.e. the weight of the switch itself and any vehicle load pushes the switch frame a slight (less than 1/16") additional distance against the backup stop structure.

To enable the switch frame 110 to rotate into the main lane position shown in FIG. 2, the bottom plate of the longitudinal I beam 202 of the frame 110 is notched to remove its corner portion that would otherwise contact the frog end stop 157A and prevent the switch frame 110 from being rotated fully into its main lane position.

As shown in the upper right hand corner of FIG. 2, a safety stop 157D is also preferably provided on the point end of the rotary switch. In this instance, the stop 157D is secured to the rotary frame and it has a projecting finger that engages a stop structure 157B on the point end fixed frame 153 if lockpin support fails in the illustrated main lane position.

In the turnout position of the switch, the bottom surface of the frog end stop 157A similarly provides backup support for the inner surface (upwardly facing in the switch turnout position) of the abutting corner portion of the bottom (in turnout position) flange of the I beam 204. The opposite (top) flange of the I beam 204 is notched as indicated by 157E so that it can pass the stop 157A as the switch frame rotates into its turnout position. The point end stop structure 157C on the point end fixed frame 153 likewise provides backup support in the turnout position for frame stop structure 157D.

Figure 2B:
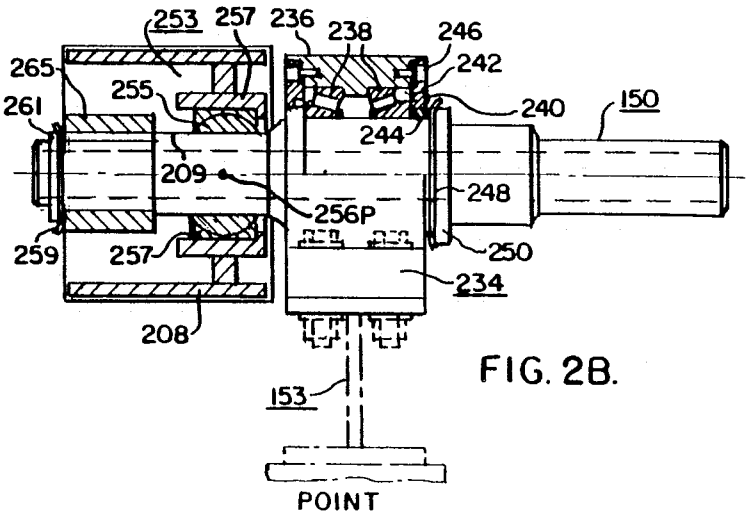
FIGS. 2A and 2B are views taker along the indicated reference planes in FIG. 2 to show the manner in which longitudinal rotary frame expansion is enabled by rolling or floating end beam support provided for the rotary frame by a point end shaft and with vertical support provided at both ends of the frame.
Figure 2A:
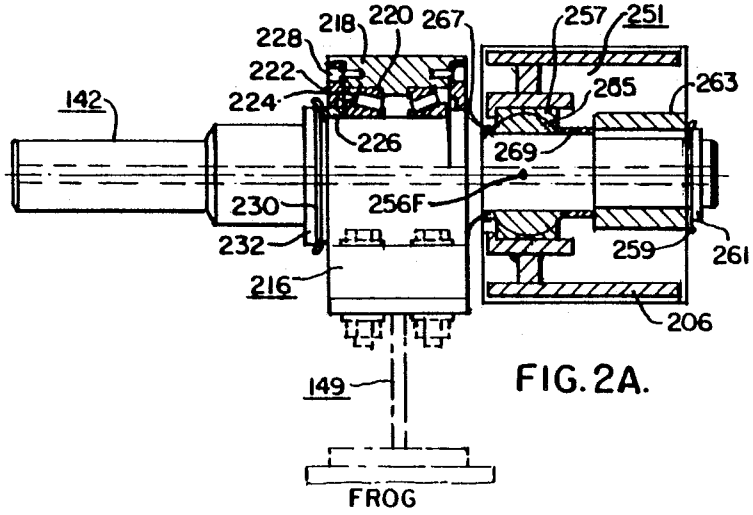

Support structures for the frog end drive shaft 142 and the point end shaft 150 are shown respectively in FIGS. 2A and 2B.

As shown, the drive shaft 142 is supported relative to the fixed equipment frame 149 by means of a fixed tapered roller bearing assembly 216 on which the switch frame is rotated. The tapered roller bearing assembly is a long-life, anti-friction unit that provides smooth operation and includes the following elements:

218 pillow block and grease fitting
220 bearing cone and bearing cup
222 bearing seal
224 seal retainer and gasket
226 bearing sleeve
228 screw
230 lock washer
232 locknut The point end shaft 150 is supported relative to the fixed equipment frame 153 by means of another fixed tapered roller bearing assembly 234 on which the switch frame is rotated. As above, the tapered roller bearing assembly 234 includes the following elements:

236 pillow block and grease fitting
238 bearing cone and bearing cup
240 bearing seal
242 seal retainer and gasket
244 bearing sleeve
246 screw
248 lock washer
250 locknut The two switch frame shafts 142 and 150 are respectively supported relative to the switch frame cross beams 206 and 208 by similar spherical bearing assemblies 251 and 253 which accordingly provide structural bearing for the switch frame. Each of the spherical bearing assemblies 251 and 253 includes the following elements:

255 spherical bearing supported on shaft
257 bearing seat
259 lock washer
261 locknut A crankarm 263 is provided with the bearing assembly 251 and another crankarm 265 is provided with the bearing assembly 253. Each crank arm 263 or 265 is secured to its shaft 142 or 150 and extends radially outwardly to a point where it has an end portion coupled to the switch frame cross beam 206 or 208. Accordingly, when the crank arm 263 is driven by the shaft 142, it provides rotational drive force for the switch frame 110. The crank arm 265 similarly connects the passive point end shaft 150 and frame end beam 208 for coupled movement. While the point end crank arm 265 transmits no drive force to the switch frame because the point end shaft 150 is free to rotate, it does tie the frame movement to the movement of the point end shaft 150 so that point end shaft position can be used to confirm the frame point end position with the frame frog end position with use of a position detection device.

The frog end bearing assembly 251 includes spacers 267 and 269 which fix the bearing 257 and the shaft 142 against relative movement in the axial direction. Thus, the frog end of the switch frame is fixed against movement in the longitudinal direction which could otherwise occur as a result of thermal expansion and contraction of the switch frame 110 or as a result of frame bending under vehicle load or vehicle braking or acceleration forces.

At the point end of the frame 110, spacers like the spacers 267 and 269 are omitted thereby enabling the frame point end to undergo longitudinal movement under thermal or vehicle load. In the illustrated embodiment, space is provided for about ⅜ inch outward (rightward) or longitudinal frame movement due to thermal expansion whereas the expected maximum outward movement is ¼ inch. As indicated by reference character 209, space is provided for about 1 inch inward (leftward) longitudinal frame movement due frame bending under vehicle load or due to thermal contraction or installation tolerances.

Figure 2D:
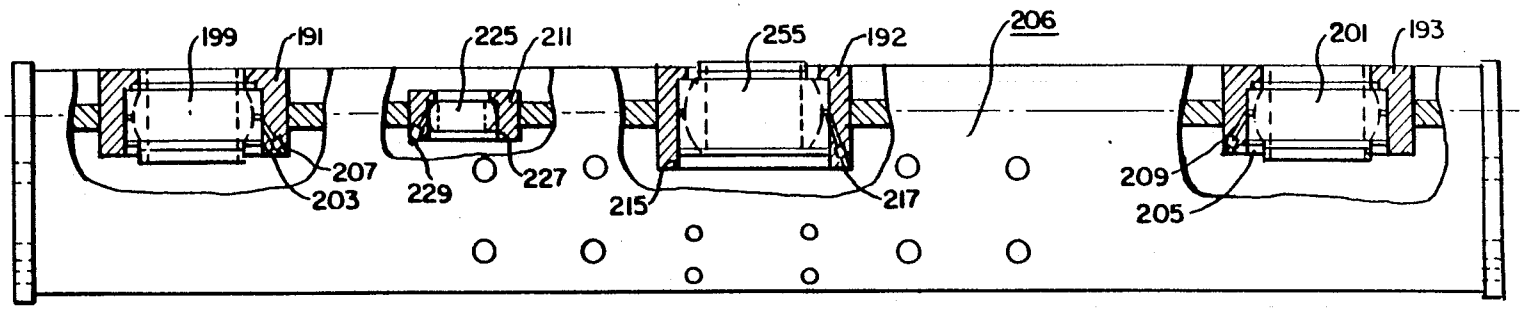
FIGS. 2C and 2D respectively are elevation and broken away top plan views of one of the frame end beams which receive lockpin and shaft support for the switch frame.
Figure 2C:
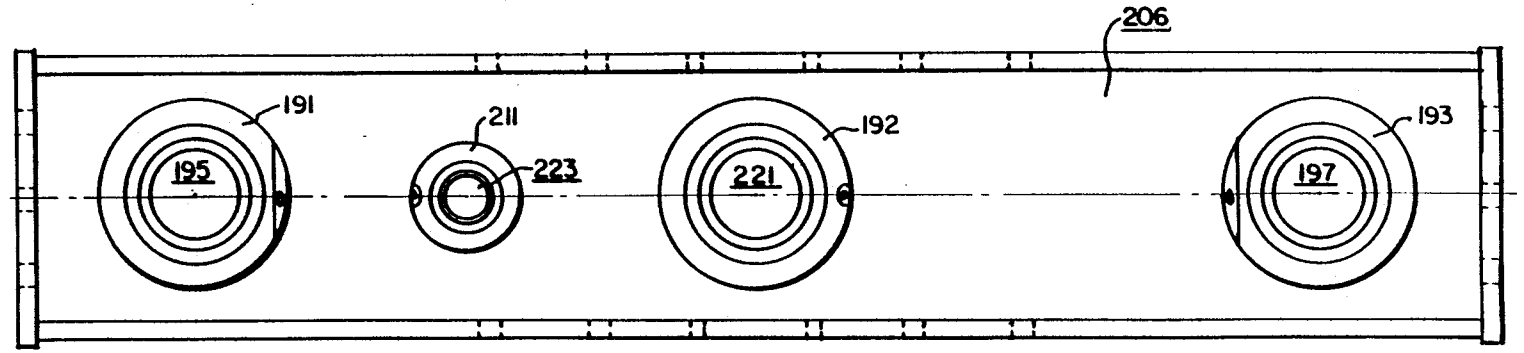

FIGS. 2C and 2D show enlarged views of the frog end cross beam 206 for the guideway switch frame 110. The point end cross beam 208 is the same as the beam 206.

As shown in the elevational view of FIG. 2C, the end beam 206 has respective seats 191 and 193 having openings 195 and 197 for receiving lock pins when the rotary switch frame 110 is rotated into either of its two guideway operation positions. As shown in the plan view having portions broken away (FIG. 2D), lock pin support is provided by a spherical bearing 199 or 201 which is provided with a retaining ring 203 or 205 and a grease fitting 207 or 209.

At a central location of the rotary frame end beam 206, the bearing seat is provided with an opening 221 for receiving the frog end drive shaft 142. The spherical bearing 255 provides shaft support. A retaining ring 215 and a grease fitting 217 are again provided for the bearing 255.

To provide for switch frame rotation, the end beam 206 additionally has a seat 211 with an opening 223 for receiving the radially outward end of the crankarm 263 which is connected to the frog end drive shaft 142. A spherical bearing 225 supports the crankarm 263. Again, a retaining ring 227 and a grease fitting 229 are provided for the bearing 225.

The preferred shaft support arrangement for the switch frame 110 is type of load support structure referred to as a Simple Supported Beam. This type of support is schematically shown in FIGS. 2E and 2F.

Figure 2E:
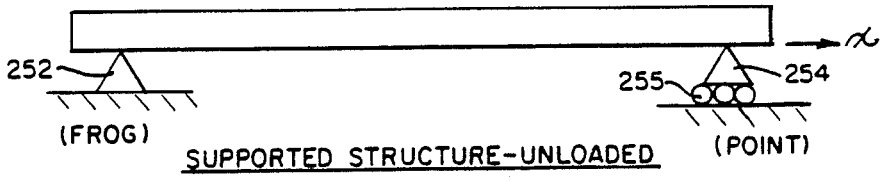
FIGS. 2E and 2F show schematic load diagrams illustrating the operation of the load support arrangement for the switch frame.

In the unloaded condition shown in FIG. 2E, the switch frame 110 extends between its fixed support (frog) end 252 and its longitudinally expandable support (point) end 254. Rollers 255 are used to designate the expandability of the point end support.

Figure 2F:
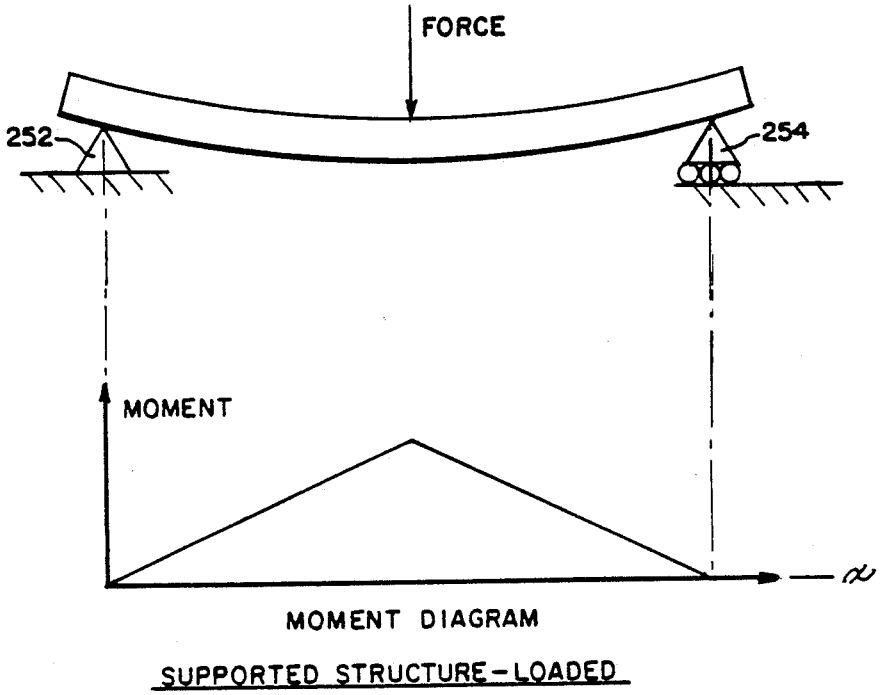

In the loaded condition shown in FIG. 2F, the expansion end support 254 has moved slightly to the left to follow the leftward movement of the point end of the frame caused by downward frame deflection under the load "F". As a result, both ends of the switch frame 116 may rotate freely allowing downward frame bending about a transverse hinge line located at each end support where it passes through the centerline of the frame end beam supporting spherical bearings (see FIGS. 2A, 2B, 2C and 2D).

In other words, the lockpins and rotating shaft are mounted on spherical seats located on a common reference line thereby freeing the framework to rotate about the center line as a hinge line under induced vehicle load. With hinge line rotation, translational forces to the hinge line are always vertical, and moments are distributed along the switch framework while essentially no bending moments are induced on the lockpins and shafts, i.e. the latter are significantly reduced in size compared to fixed end support (such as straight bore as opposed to spherical bearing receptacle). In effect, the switch frame carries vehicle load and transfers minimal bending moments to the supporting shafts and lockpins without frame leveraging that would otherwise cause high stresses on the shafts and lockpins.

The hinge line is designated by the reference character 256F in FIG. 2 at the frog end and is best observed in FIG. 2A. A similar hinge line 256P operates at the point end of the frame, and it is best observed in FIG. 2B.

As a result of the operation of the preferred simple support structure for the switch frame support arrangement, vehicle load forces are transmitted through the frame hinge lines essentially as shear stress on the shafts and the lock pins. Otherwise, bending loads applied over the length of the switch frame would produce high tensile stresses on the shafts and locking pins thereby requiring excessively or impractically sized structures for these supporting elements.

It is also significant that the described spherical bearing support structure provides a self-aligning feature permitting 180° rotation of this switch frame 110 without binding against the shafts due to thermal distortion or due to manufacture to accuracy limitations. This self-alignment occurs since the spherical bearings can rotate relative to the switch frame.

Preferably, the lock pin spherical bearings have extended rings that limit the extent of bearing rotation relative to the switch frame thereby assuring alignment conditions for lock pin insertion, to line up with centerlines of the frame support shafts. The lock pin spherical bearings similarly provide self-alignment since the bearings can rotate relative to the switch frame to permit lock pin alignment with the bearings when the switch is rotated into position for lock pin insertion.

In a particular commercial embodiment, the framework was formed from A36 steel employing both rolled and fabricated structural sections. The framework had a span of 31 feet 3 inches, a depth of 17 inches and a width of 6 feet 7 and ¼ inches. To minimize the cumulative effects of fatigue, all connections except one were secured by high strength bolts. Maximum live load deflection at midspan was ¼ inch.

DOUBLE TURNOUT ROTARY GUIDEWAY SWITCH

Figure 3A:
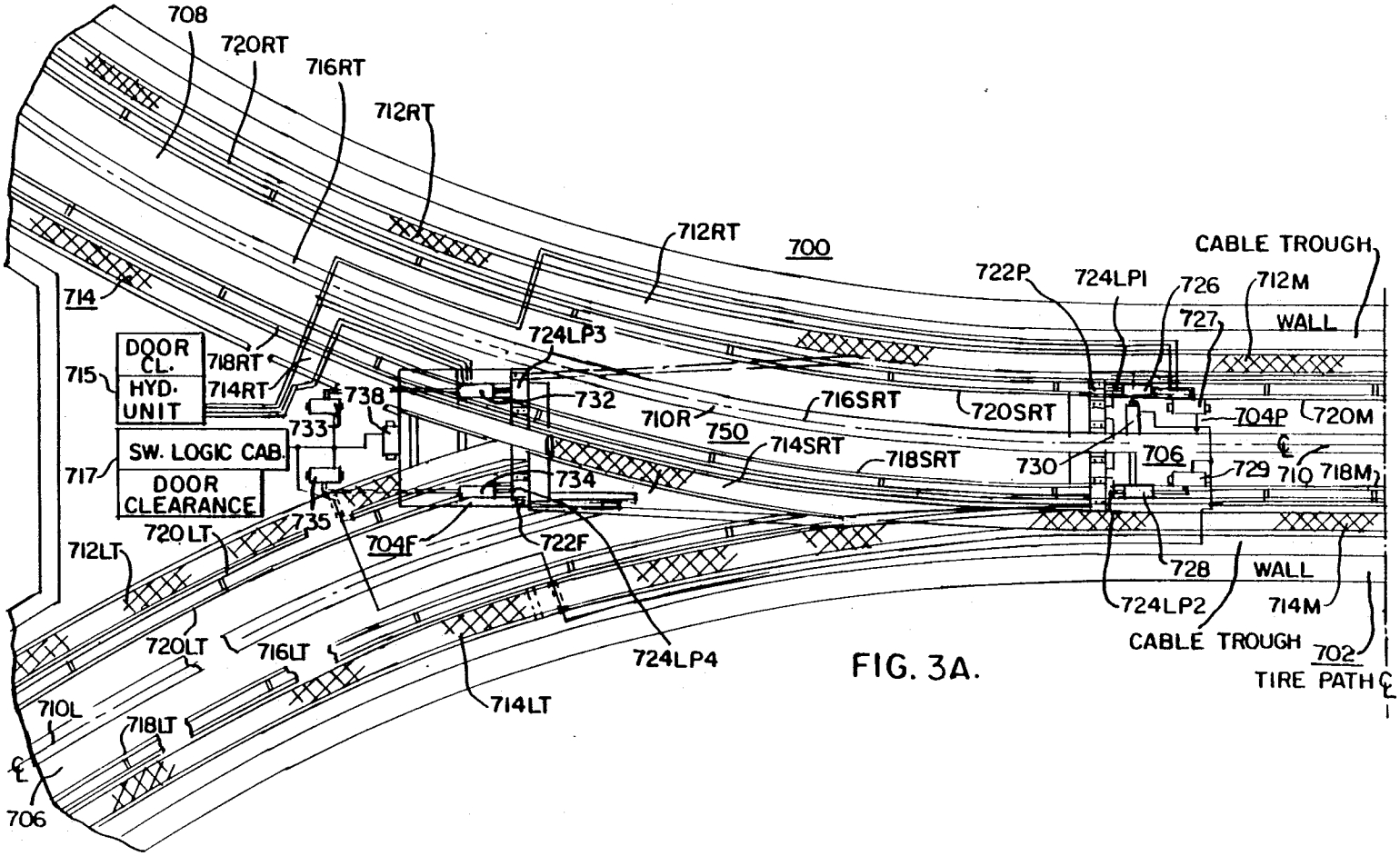
FIG. 3A shows a top plan view of the preferred embodiment of the invention, i.e. a double turnout rotary guideway switch with its right turnout side facing upwardly.

The preferred embodiment of the invention is shown in a top plan view of FIG. 3A. In this case, a generally elongated rotary guideway switch 700 provides vehicle guidance between a main lane 702 and a left turnout lane 706 or a right turnout lane 708 according to the switch position. The guideway switch 100 is thus referred to as a double turnout switch. In practice, vehicles may move in either direction across the switch 700, i.e. either into or out of the turnout lanes 706 and 708, according to the people mover system design.

The turnout lanes 706 and 708 in this preferred case are symmetrical about main lane centerline 710. Accordingly, the double turnout switch 700 and its pit 704 are also disposed in the lane intersection area symmetrically about the main lane centerline 710.

As indicated by tire paths 712 and 714, the double turnout rotary switch 700 is positioned to direct car travel from the main lane 702 to the right turnout lane 708 for vehicles moving out of the main lane 7C2. The tire path 712 includes main lane portion 712M and right turnout lane portion 712RT which are formed by fixed guideway structure, whereas the tire path 714 includes main lane portion 714M, switch portion 714SRT and right turnout lane portion 714RT. The upwardly facing, right turnout side of the switch 700 provides the right turnout switch tire path 714SRT as well as a right turnout guidebeam 716SRT and turnout power and signal rail structure 718SRT and 720SRT. Four rails are shown on both sides to illustrate all combinations of rail installations and associated clearance for the illustrated embodiment.

A similar but opposite guideway switching interface is provided by the left turnout side of the rotary switch 700 which is rotated into an upwardly facing position (not indicated in FIG. 3A) when the switch 700 rotated about its longitudinal centerline through 180 degrees. Thus, the main lane tire path 712M is connected to left turnout lane tire path 712LT by a left turnout tire path on the switch 700, while the other tire path is formed entirely by fixed structure portions 714M and 714LT. Guidebeam and electrical rail structure are also provided to complete the left turnout guideway configuration on the left turnout side of the switch 700.

As previously, the pit 704 is provided with a frog end 704F and a point end 704P. Frog and point end equipment frames 722F and 722P support frame 700F of the double turnout switch 700 in a manner like that described for the single turnout switch, i.e. by means of lock pins and shafts.

At the point end, switch supporting lock pins 724LP1 and 724LP2 are operated by hydraulic actuators 726 and 728 with lock pin positions sensed respectively by sensors 727 and 729. A sensor 730 detects the position of a switch supporting point end shaft (not visible in FIG. 3A—see 736P in FIG. 3D).

Switch supporting lock pins 724 LP3 and 724LP4 are operated at the frog end by hydraulic actuators 732 and 734 with lock pin positions sensed respectively by sensors 733 and 735. A frog end drive shaft 736F (FIG. 3D) supports the switch frame, is driven by rotary actuator 737 and its position is sensed by unit 738.

The point end of the pit 706 is similar to that described for the single turnout guideway switch. As a result of space limitations presented by the guideway structure at the frog end of the pit 704, the position sensors 733, 735 and 738 are located outside the pit 704 and suitable couplings are provided through the guideway wall structure to enable these units to function as required.

Equipment frames mounted in the frog and point end pits for the double turnout guideway switch are conceptually like the equipment frames described for the single turnout guideway switch, with some structural differences providing for different mounting requirements. Generally, the equipment frames in both cases are symmetric about the centerline of switch rotation which as previously noted is the same as the guideway centerline.

A hydraulic control unit 715 and a switch logic cabinet are preferable, disposed outside the guideway structure and between the turnout lanes 706 and 708. Hydraulic and electrical line connections are generally made as previously described for the single turnout switch.

Figure 3B:
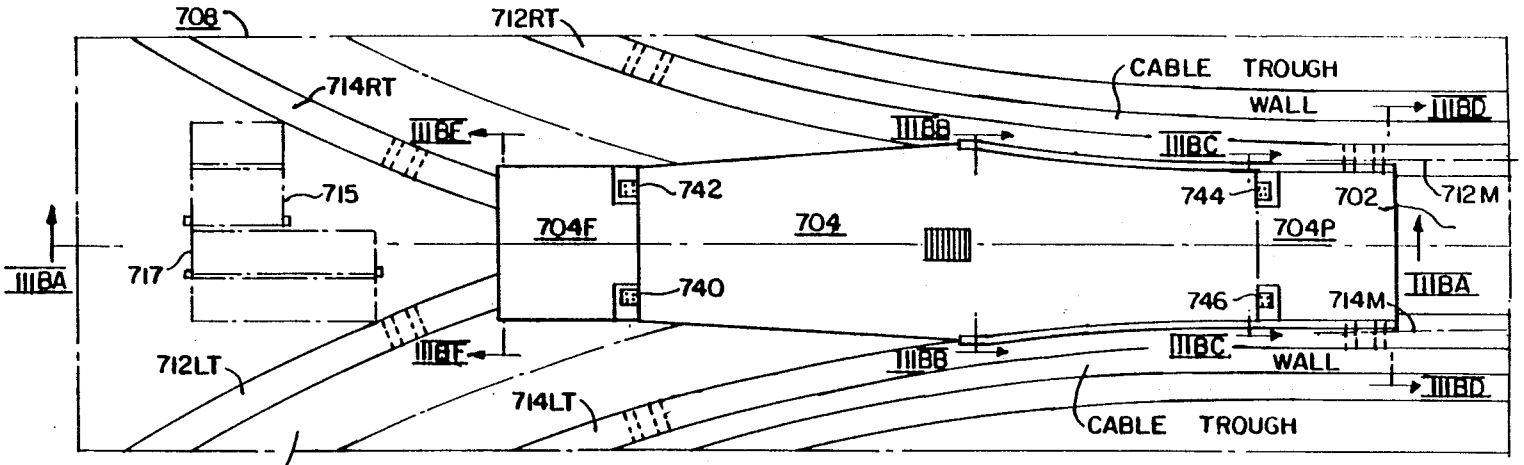
FIG. 3B shows a switch pit for the double turnout switch embodiment, i.e a view similar to FIG. 3A with the movable switch member taken away.
Figure 3B:
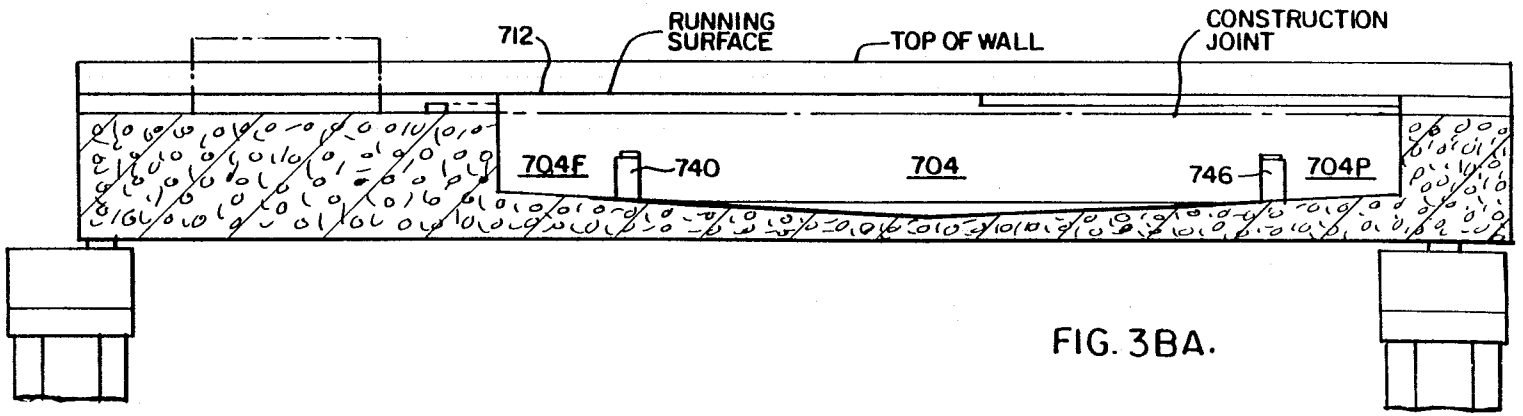

In FIG. 3B, the double turnout guideway structure is shown with the double turnout rotary guideway switch element removed. Generally, the pit 704 is contoured to the shape of the elongated switch frame 750F. Concrete pillasters 740, 742, 744 and 746 provide support for the equipment frames 722F and 722P. Structural walls are provided with cable troughs as shown.

FIG. 3BA shows the right turnout side of the pit 704. FIGS. 3BB through 3BF are taken along reference planes as indicated to show views similar to those presented for the other embodiments of the invention.

Figure 3C:
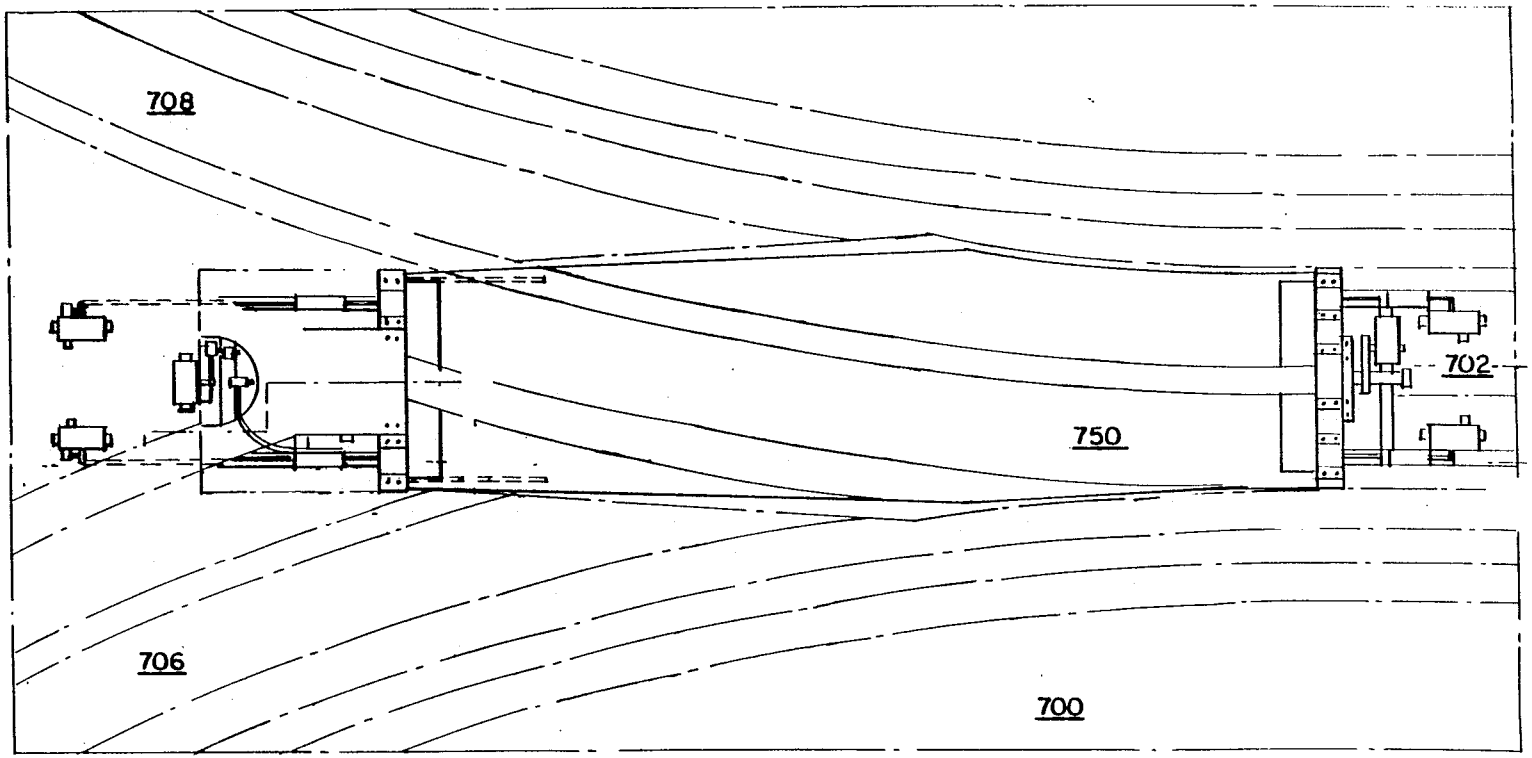
FIG. 3C shows a top plan view of the general assembly of the double turnout guideway switch.

The general assembly of the double turnout rotary guideway switch frame with its supporting structure is highlighted in the top plan view of FIG. 3C.

Figure 3D:
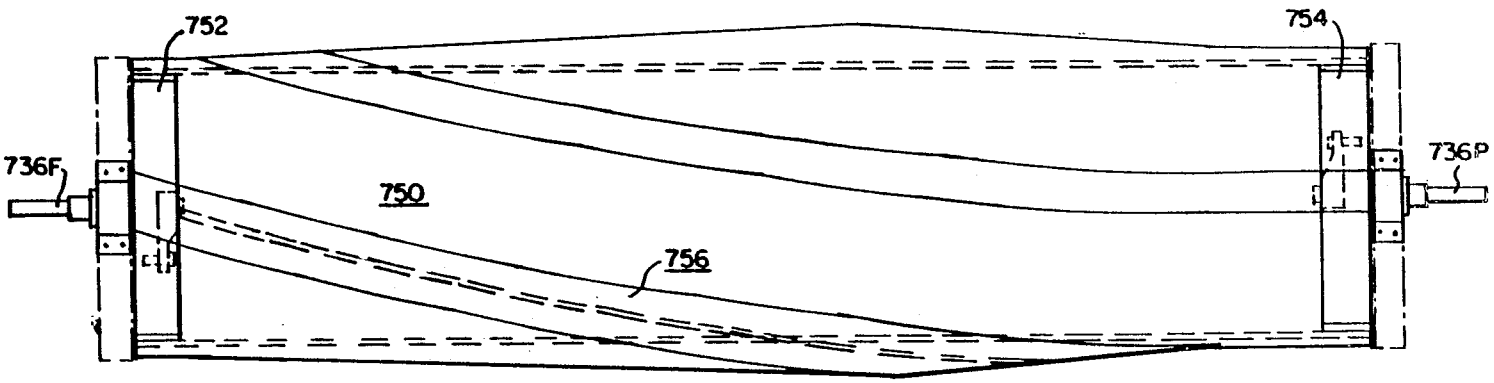
FIG. 3D shows the right turnout side of a switch frame assembly for the double turnout guideway switch.
Figure 3B:
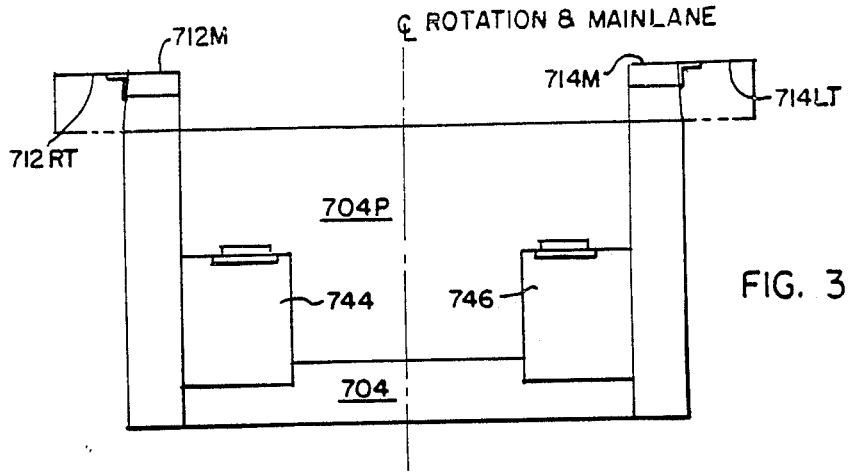
Figure 3B:
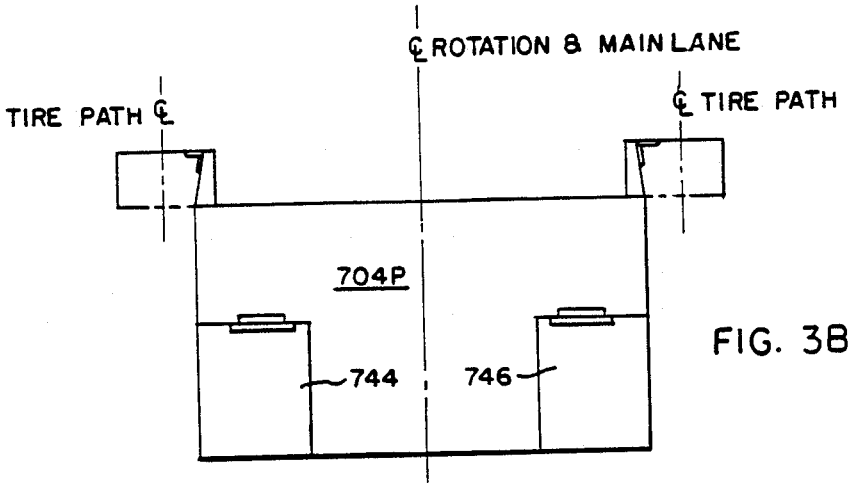
Figure 3B:
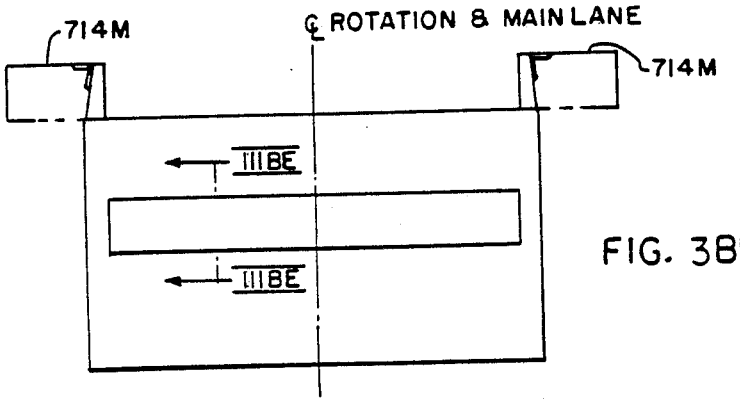
Figure 3B:
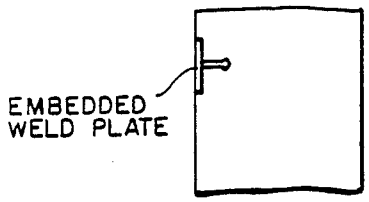
Figure 3B:
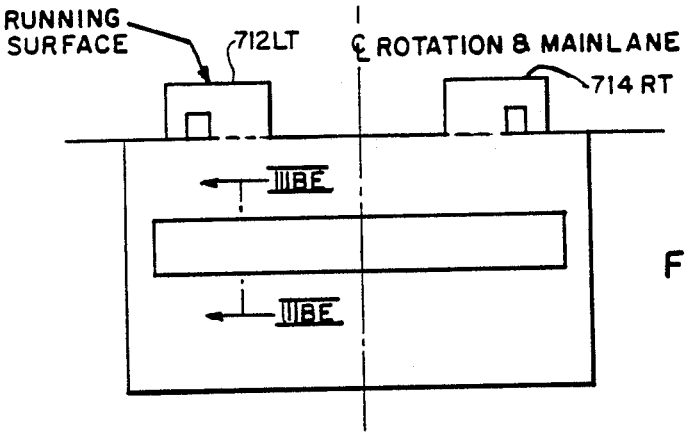

In FIG. 3D, a top plan view is shown for the right turnout side of a generally rectangularly shaped frame assembly 750 for the double turnout rotary guideway switch. Views taken along reference planes A—A and B—B are like those shown in FIGS. 2E and 2F which highlight the preferred simple shaft support arrangement for guideway switches made in accordance with the invention.

As in the case of the single turnout switch embodiment, the frame 750 is made symmetrical about the axis of rotation except to the extent that asymmetry is needed to meet requirements of guideway configuration and structural strength. Specifically, curved portion 756C of the turnout beam 756 is disposed relative to the axis of frame rotation such that its outwardly facing tire path surfaces form right and left switch turnout paths that are symmetric about the axis of frame rotation as the switch frame is rotated from one turnout position to the other turnout position.

The double turnout frame assembly 750 has respective end beams 752 and 754 supported by the shafts 736F and 736P. As previously, crankarms tie the switch shafts to the double turnout switch frame through frame end beams to transmit rotational drive force to the frame at the frog end and to provide position indication at the point end.

The frame support shafts extend through spherical bearings seated in the respective frame end beams 752 and 754. As in the case of the single turnout switch embodiment, frame deflection occurs rotationally about respective end hinge lines passing through the lock pin seats and the frame shaft seats in the respective switch frame end beams.

Beam structure including a turnout beam 756 extends longitudinally and ties the end beams 752 and 754 together to form the basic structure of the frame assembly 750.

Figure 3E:
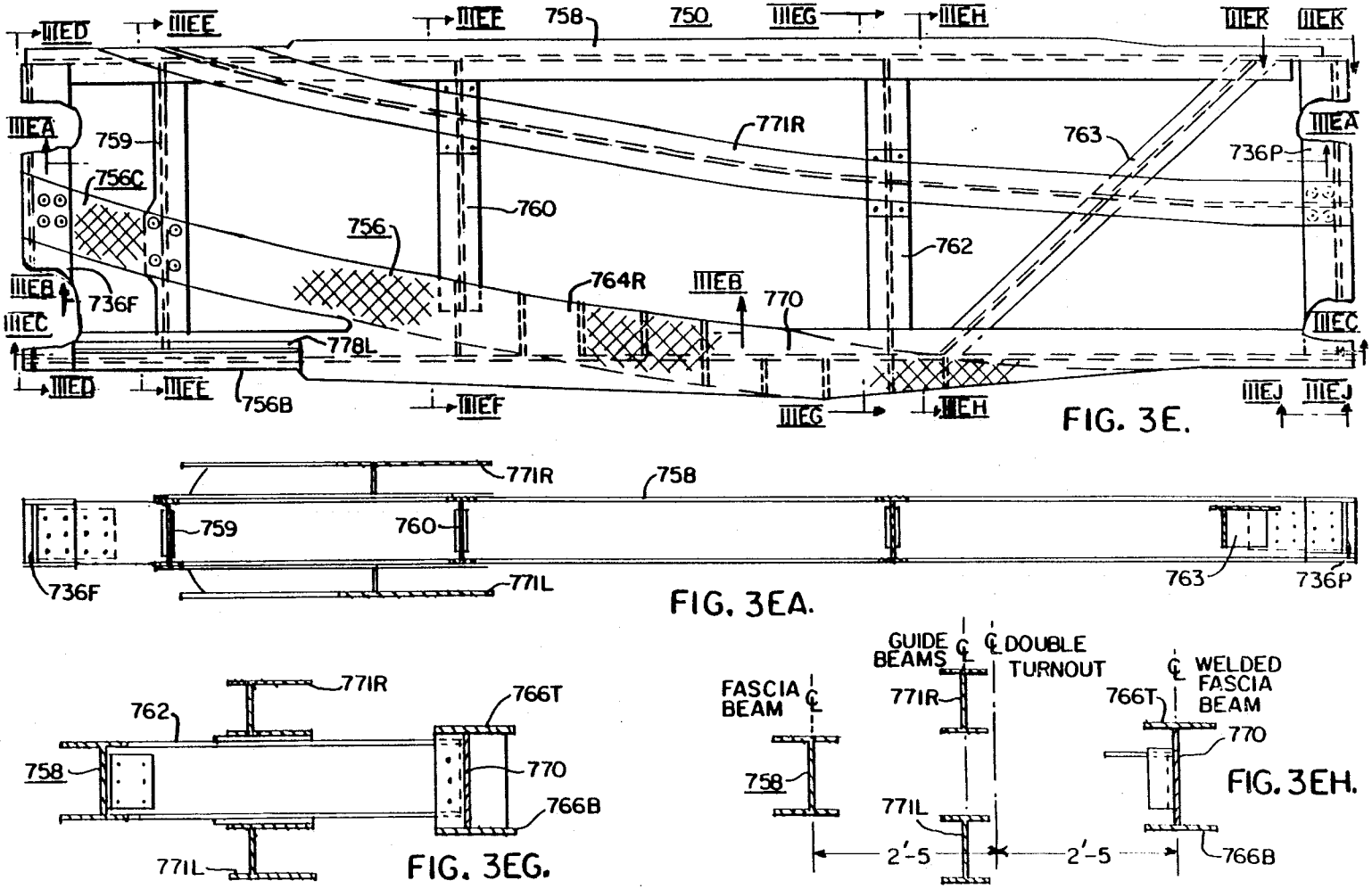
FIGS. 3E and 3EA through 3EH respectively show a top plan view of the double turnout switch frame and various views taken along the indicated reference planes in FIG. 3E.
Figure 3E:
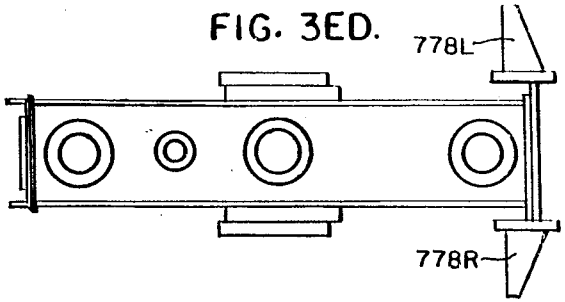
Figure 3E:
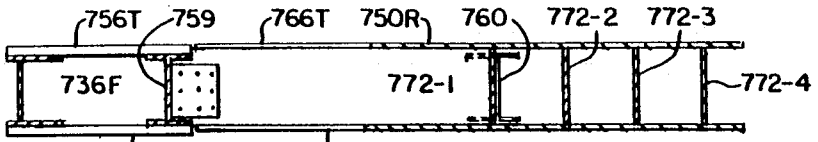
Figure 3E:
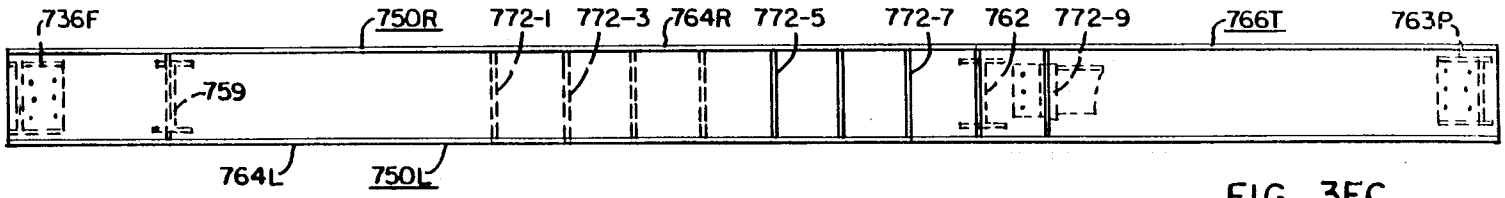
Figure 3E:
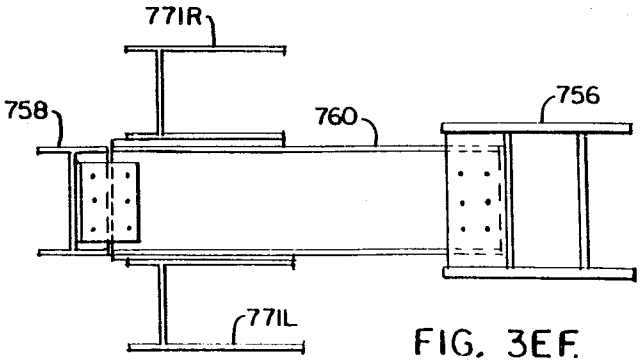
Figure 3E:
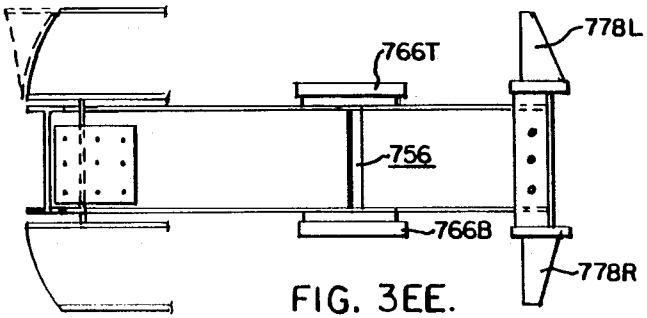
Figure 3E:
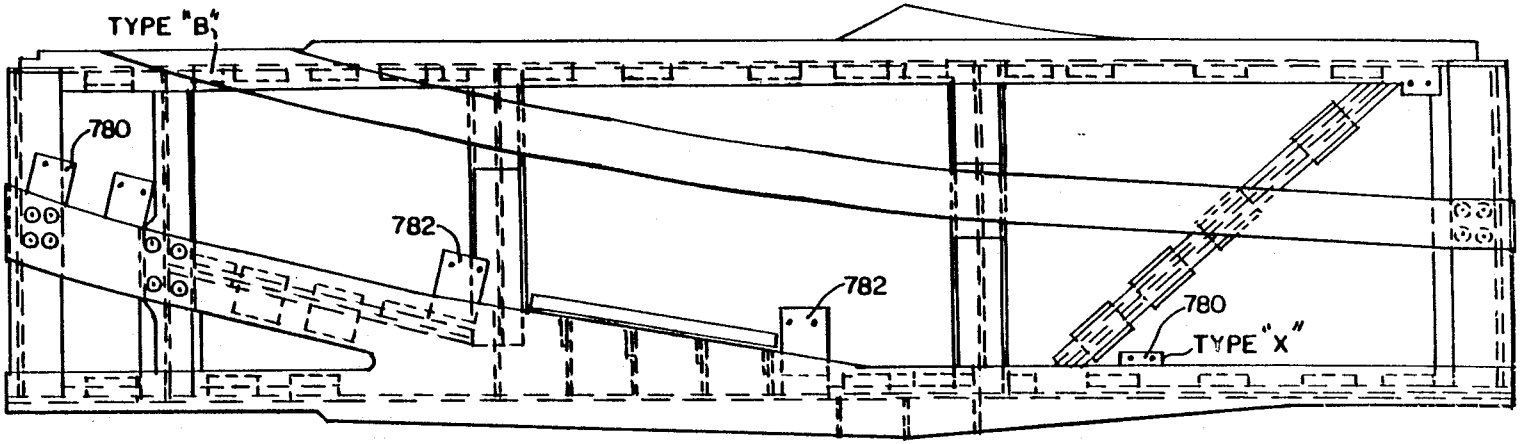
Figure 3E:
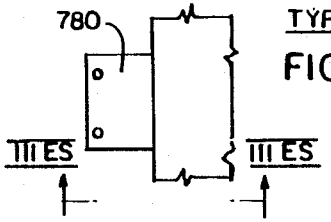
Figure 3E:
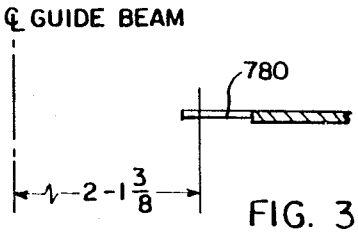
Figure 3E:
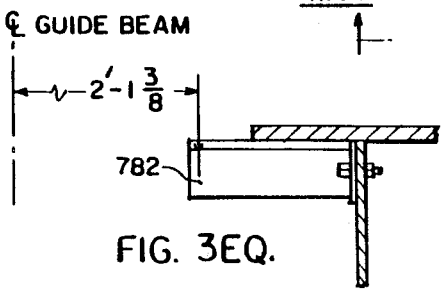
Figure 3E:
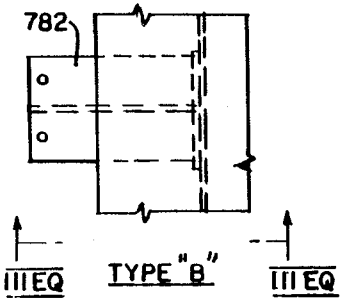

More structural detail is presented for the frame assembly 750 in the top plan view shown in FIG. 3E and in FIGS. 3EA–3EH which are taken along the respective designated reference planes of FIG. 3E. The right turnout side of the switch frame assembly 750 is seen in FIG. 3E, with the left turnout side of the switch frame 750 being located on the underside of the view.

Generally, the previously noted turnout beam 756 and an another elongated beam 758 form the longitudinal sides of the frame 750 and together provide the beam structure that tie the end beams together in forming the basic frame structure. The side beam 758 has less height than the turnout beam 756 since the turnout beam 756 is relatively elevated to provide turnout running surfaces for tires on one side of any vehicle that runs over the guideway switch for either a right or a left turnout.

The turnout beam 756 has the curved portion 756C which defines the turnout tire path on both sides of the switch frame 750. A side branch 756B of the turnout beam 756 extends to and secures to an end portion 757 of the frog end beam 736F thereby providing outer frame structure in the frame area where the curved beam portion 756C is located. Additional cross beams 759, 760 and 762 and diagonal beam 763 complete the frame structure 750.

The shaded path shown in FIG. 3E is the portion of top plate 766T that forms the right turnout tire path.

As observed best in FIG. 3EC, right turnout tire running surface 764R on right turnout side 750R of the switch frame 750 and left turnout tire running surface 764L on left turnout side of the switch frame 750 are in vertical alignment and are formed respectively by top and bottom plates 766T and 766B (FIG. 3EE) of the turnout beam 756.

To make the turnout beam 756, it is preferred that the top and bottom plates 766T and 766B be configured with the generally Y-shape observed in FIG. 3E and formed into beam structure by means of intersecured elongated web members 758 and 770 and cross web members 772-1 through 772-9 (FIG. 3EC). In this case, the curved beam portion 756C is formed as described to the point where it meets the cross beam 759. At that point, the curved beam 756C is "continued" to the frog end beam; 736F by the use of aligned top and bottom bridge plates 756T and 756B (FIG. 3EB).

Guidebeam structure is provided for the right turnout side 750R of the switch frame 750 by a curved guide beam 771R that is secured to the side beam 758 (FIGS. 3E and 3EA) and to cross beams 760 and 762 and point end beam 736P (FIG. 3E). A like curved guidebeam 771L (FIG. 3EA) is provided on the left turnout side 750L of the switch frame 750 in vertical alignment with the guidebeam 770R.

Electrical rails (not shown) for the double turnout guideway switch are like those described for the single turnout guideway switch. They are secured to the frame 750 by means of brackets 780 and 782 which are detailed in FIGS. 3EN–3ES.

The rotational backup stop structure for the switch frame 750 rotation is detailed in FIGS. 3CA, 3CB and 3EJ-3EM. As shown on the point end in FIG. 3CA, a stop structure 740P is secured to the point end fixed equipment frame and is positioned to engage a stop block 742P on the movable switch frame 750 as the switch rotates to the right hand turnout position. In the left hand turnout position, the underside of the stop structure 740P is engaged by a stop block 744P. Just prior to reaching either turnout position, the switch frame 750 is brought to a smooth stop in alignment for insertion of the primary supporting lock pins. The described stop structure acts as a backup support in the event the lock pins fail to be inserted, i.e., the weight of the switch itself and all vehicle induced loads force the movable switch frame a slight distance (approximately 0.06 inches) against the stop structure 740P. This self-alignment feature enhances the safety of the rotary switch. As shown in FIG. 10CB, stop end structure 740F is secured diagonally opposite the stop 740P. The stop 740F essentially operates like the point end rotational backup stop 740P. Stop block details are shown in FIGS. 3EJ and 3EK.

When the double turnout switch frame 750 is in the right turnout position shown in FIG. 3E or in the left turnout position (not shown), a vehicle moving over the switch always applies a portion of its weight only to the turnout beam 756 through the tires on the left side of the car (right turnout) or the tires on the right side of the car (left turnout). Accordingly, the force of the vehicle weight always (right or left turnout) tends to rotate the switch frame 750 about its axis of rotation toward the safety rotational stops 740P and 740F.

As an additional safety feature, vehicle wrong entry guidewheel stops are provided to keep a vehicle locked on the guideway if the vehicle enters a switch with the switch aligned for the turnout position opposite to the turnout on which the vehicle is located. A stop 778L (FIGS. 3EA and 3EE) provides protection in the left hand turnout position of the switch and a stop 778R provides protection in the right hand turnout position of the switch.

What is claimed is:

1. A double turnout rotary switch for a people mover guideway system having a predetermined two-tire path, guidebeam and electric rail configuration, said rotary switch providing for routing a transit car having load bearing tires from a main line entry guideway path to a left turnout exit guideway path or a right turnout guideway exit path and comprising:

an elongated structural switch frame member having guidebeam, electric rail and tire path structure on one side compatible with the guideway configuration to provide car routing to said left turnout exit path; said switch frame member further having guidebeam, electric rail and tire path structure on another side compatible with the guideway configuration to provide car routing to said right turnout exit path;

first support means having first shaft means for supporting one end of said switch frame member.

second support means having second shaft means for supporting the other end of said switch frame member;

means for driving at least one of said shaft means to rotate said switch frame about an axis of rotation between first and second frame positions;

said switch frame member having its one side aligned with the entry guideway path and the one exit guideway path in said first frame position and having its other side aligned with the entry guideway path and the other exit guideway path in said second frame position; and means for locking said frame member against rotation from said first or second frame position.

2. A double turnout rotary guideway switch as set forth in claim 1, wherein said switch frame member includes: a pair of laterally spaced, elongated beam means operating as principal structural members for said switch frame member; and curved beam means extending longitudinally and laterally inwardly from one of said elongated beam means to one end of said switch frame member, said curved beam means having on one side thereof an elongated curved surface facing outwardly to the one side of said switch frame member to provide for one left turnout tire path over the switch for the tires on one side of the car, and said curved beam means having on another side thereof another elongated curved surface facing outwardly to the other side of said switch frame member to provide for one right turnout tire path over the switch for the tires on one side of the car.

3. A double turnout rotary guideway switch as set forth in claim 2, wherein said switch frame member further includes: a first end beam means laterally extending between and secured to said elongated beam means at one end thereof; and a second end beam means laterally extended between and secured to said elongated beam means at the other end thereof, said first and second end beam means respectively supported by said first and second support means, and said curved beam means extending to said one end beam means.

4. A double turnout rotary guideway switch as set forth in claim 3, wherein said curved beam means joins said first end beam means substantially at its midpoint and said first shaft means and said axis of frame rotation extend through said first end beam means at its midpoint thereby enabling said beam curved surfaces to provide for symmetric location of said left and right turnout switch the paths relative to said axis of frame rotation as said switch is rotated between the left and right turnout position.

5. A double turnout rotary guideway switch as set forth in claim 3, wherein cross beam means are secured between said elongated beam means to provide cross support for said switch frame member.

6. A double turnout rotary guideway switch as set forth in claim 2, wherein said first support means includes first means for supporting said switch frame member in fixed relationship to said first shaft means at one end of said switch frame member, and said second support means includes second means for supporting said switch frame member in longitudinally expandable relation to said second shaft means at the other end of said switch frame member.

7. A double turnout rotary guideway switch as set forth in claim 2, wherein said first and said second means and said locking means further support said switch frame member for pivotal deflection about respective transverse hinge lines at the two ends of said switch frame member.

8. A double turnout rotary guideway switch as set forth in claim 2, wherein said curved beam means and said one elongated beam means are cooperatively related to provide the only tire path over said switch on each switch side.

9. A double turnout rotary guideway switch as set forth in claim 8 forming a combination with first fixed guideway structure means providing a second tire path operative with the switch tire path on said one switch side to provide said left turnout path; and second fixed guideway structure means providing another second tire path operative with the tire path on said other switch side to provide said right turnout path.

10. A double turnout rotary guideway switch as set forth in claim 2, wherein the elongated curved surfaces on said curved beam means form at least most of said switch turnout tire paths.

11. A double turnout rotary guideway switch as set forth in claim 2, wherein said switch frame member further includes: curved switch guidebeam means and curved switch electric rail means supported on the one side of said switch frame member above said one left turnout tire path and between said one switch left turnout tire path and the other left turnout tire path when said switch is in said one frame position; and another curved switch guidebeam means and another curved switch electric rail means supported on the other side of said switch frame member above said one right switch turnout tire path and between said one switch right turnout tire path and the other right turnout tire path when said switch is in said other frame position.

12. A double turnout rotary guideway switch as set forth in claim 2, wherein said switch frame member further includes first backup stop means for supporting said switch frame member in said first frame positions; and second backup stop means for supporting said switch frame member in said second frame position if said locking means fails to operate properly;

said switch frame member and its guideway configuration structure being arranged in form and weight relative to said axis of rotation to provide: (1) the described car guidance on the respective switch sides; (2) self-aligning forces urging rotational movement of said switch frame member toward said first or second backup stop means; and (3) car loading forces urging rotational movement of said switch frame member toward said first or second backup stop means when a car moves over either switch side.

13. A double turnout rotary guideway switch as set forth in claim 12, wherein said first and said second support means and said locking means further support said switch frame member for pivotal deflection about respective transverse hinge lines at the two ends of said switch frame member.

* * * * *